US006139480A

United States Patent [19]

Moss et al.

[11] Patent Number: 6,139,480

[45] Date of Patent: Oct. 31, 2000

[54] CUTTING DEVICE FOR EFFECTING A PARTIAL CUT IN A PACKAGING MATERIAL, AND A BLANK PRODUCED THEREFROM

[75] Inventors: Sheila Moss, Barrington; Stuart Schwartz, Chicago, both of Ill.; Johan Lindstrom, Sandby, Sweden; Theo Louman, Hoor, Sweden; Rolf Borgstrom, Lomma, Sweden

[73] Assignee: Tetra Laval Holdings & Finance, SA, Pully, Switzerland

[21] Appl. No.: 09/238,803

[22] Filed: Jan. 28, 1999

[51] Int. Cl.[7] ..... B31B 1/14

[52] U.S. Cl. ..... 493/55; 493/56; 493/62; 493/324; 493/340

[58] Field of Search ..... 493/55, 56, 61, 493/62, 320, 324, 340, 372; 229/125.15

[56] References Cited

U.S. PATENT DOCUMENTS

| | | | |
|---|---|---|---|
| 2,521,985 | 9/1950 | Lang et al. . | |
| 3,060,816 | 10/1962 | Martin . | |
| 3,481,813 | 12/1969 | Wiggers . | |
| 3,648,605 | 3/1972 | Hottendorf | 493/55 |
| 3,899,120 | 8/1975 | Fradkin . | |
| 3,972,270 | 8/1976 | Marshall . | |
| 4,007,671 | 2/1977 | Duncan . | |
| 4,195,557 | 4/1980 | Kang . | |
| 4,222,311 | 9/1980 | Jaton | 493/55 |
| 4,518,377 | 5/1985 | Skinner . | |
| 4,582,555 | 4/1986 | Bower . | |
| 4,596,541 | 6/1986 | Ward, Sr. et al. . | |
| 4,610,649 | 9/1986 | Friess | 493/55 |
| 4,625,534 | 12/1986 | Hemmi et al. . | |
| 4,824,714 | 4/1989 | Gest . | |
| 4,930,683 | 6/1990 | Farber | 229/125.15 |
| 4,968,291 | 11/1990 | Baldacci et al. . | |
| 4,989,736 | 2/1991 | Andersson et al. . | |
| 5,015,223 | 5/1991 | Boeckmann . | |
| 5,021,117 | 6/1991 | Boeckmann . | |
| 5,023,033 | 6/1991 | Cakmakci . | |
| 5,065,938 | 11/1991 | Anderson | 229/125.15 |
| 5,163,891 | 11/1992 | Goldsborough et al. | 493/324 |
| 5,393,295 | 2/1995 | Knecht . | |
| 5,466,211 | 11/1995 | Komarek et al. . | |
| 5,501,394 | 3/1996 | Eno . | |
| 5,823,935 | 10/1998 | Levine . | |

*Primary Examiner*—Gary E. Elkins
*Attorney, Agent, or Firm*—Welsh & Katz, Ltd.

[57] ABSTRACT

A cutting device for imparting a partial incision to a blank, the blank produced therefrom, and a method for producing are disclosed herein. The partial incision in the blank creates an access area wherein a fitment is placed thereover in a post processing fitment application. The access area has an uncut portion and an unincised portion. The access area may have a circular shape or an oval shape. The depth of the partial incision allows for facilitated rupturing by the fitment after the blank is fabricated into a carton, and a fitment is attached thereto.

7 Claims, 9 Drawing Sheets

CUTTING DEVICE FOR EFFECTING A PARTIAL CUT IN A PACKAGING MATERIAL, AND A BLANK PRODUCED THEREFROM

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a knife for cutting a packaging material. More specifically, the present invention relates to a knife for partially cutting a carton blank, and the blank produced therefrom.

2. Description of the Related Art

Gable top cartons have long been the preferred package for milk and milk related products. These well-known cartons are usually fabricated from a blank composed of a paperboard substrate coated with a thermoplastic material on both the interior and exterior surfaces. The thermoplastic material, usually low density polyethylene, has many functions including preventing the product from contacting the paperboard substrate. To fabricate a blank, a large web of coated paperboard is printed upon, scored to create the crease or fold lines, and then cut into the individual carton blanks. The blanks are then fed into a packaging machine and formed, filled and sealed to create the finished product.

Recently, gable top cartons have assumed a new role as the preferred package for juices, particularly orange juice. The consumers preference for gable top cartons is at least partially generated by the perception of freshness associated with the gable top carton. The opposing top panels meeting to form the gable top with a top fin creates an image of a fresh, healthy product contained within the carton. The only detraction from this image was the lack of a tight reseal of the carton after the initial opening of the carton by a consumer. The integrated closure formed from the side of the top of the carton allowed for good pourability, however, the resealing was adequate at best.

This minor detraction was alleviated with the introduction of plastic fitments applied to the gable top cartons. The fitments, which generally include a spout with a flange and a cap, allowed for a tight reseal of the carton after the initial opening. The use of fitments on cartons further enhanced the consumer's perception that gable top cartons contained fresh and healthy products.

In the rush to meet the consumer's demand, the packaging industry developed new packaging/filling machines that applied a fitment to cartons prior to sterilization or filling. The demand to have packaging machines with the smallest "footprint" (the area of the machine) in a dairy meant that most older machines did not have sufficient space within the machine to incorporate a fitment applicator. This rendered older machines without the ability to provide a carton with a fitment thereby reducing their value to the dairy or like facility. Thus a need to apply a fitment on a formed, filled and sealed carton grew throughout the packaging industry.

Another problem necessitating the need to apply a fitment on a formed, filled and sealed carton pertains to maintaining a sterile environment within a form, fill and seal packaging machine to produce an extended shelf life ("ESL") product, a high acid ambient distribution ("HAAD") product, or an aseptic product. The ESL product allows for a product to have double or triple the refrigerated shelf life of a non-ESL product. The HAAD product allows for a high acid (pH<4.5) product such as orange juice to be stored unrefrigerated for an extended time period. The aseptic product allows for any product to be stored unrefrigerated for an extended time period. All of these products need to be produced in a sterile, contaminant-free environment.

Thus, the packaging industry created a need to apply a fitment to a formed, filled and sealed carton. This created a need for a package that could be utilized with a fitment applied to a formed, filled and sealed carton since in-line fitment applicators would apply the fitment through a pre-incised aperture in the carton prior to filling or sterilization. Thus, a need was created for a carton that could be accessed with a post-processing applied fitment while still providing the necessary protection to the product contained therein until the initial opening of the carton by a consumer. This further created a need to produce a blank for fabrication into a carton for application of a fitment thereon after processing into a formed, filled and sealed carton.

BRIEF SUMMARY OF THE INVENTION

It is a primary object of the present invention to provide a method and device for partially cutting a packaging material to create an access area for placement of a fitment thereto.

It is an additional object of the present invention to provide a blank having an access area with a partial cut thereto in order to provide a carton for post processing application of a fitment thereto.

It is an additional object of the present invention to provide a device for partially cutting an oval shape into a carton blank.

It is an additional object of the present invention to provide a device for partially cutting a circular shape into a carton blank.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

There is illustrated in FIG. 1 a plan view of a carton blank of the present invention.

There is illustrated in FIG. 2 an alternative embodiment of a carton blank of the present invention.

Figure 1:
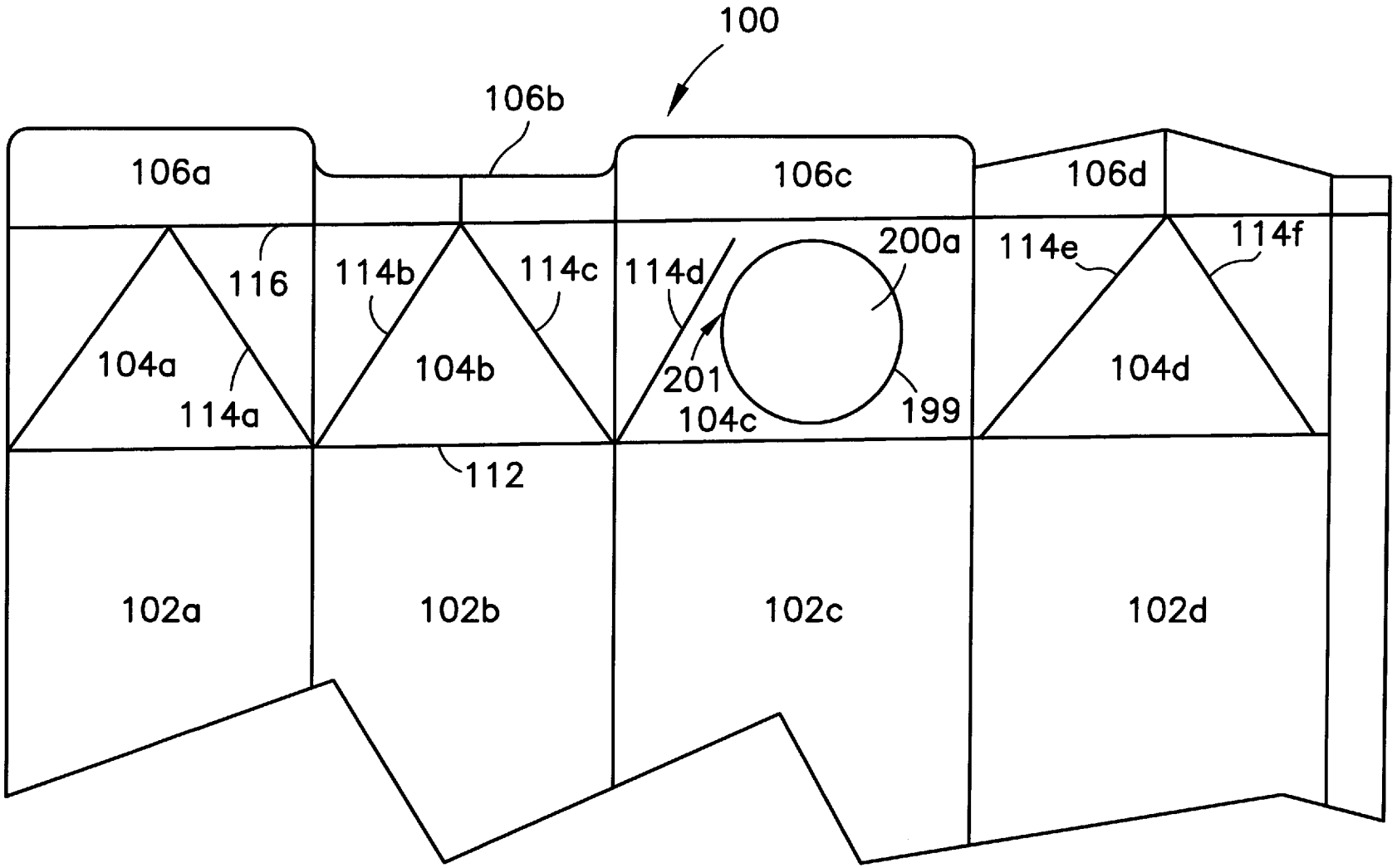
Figure 2:
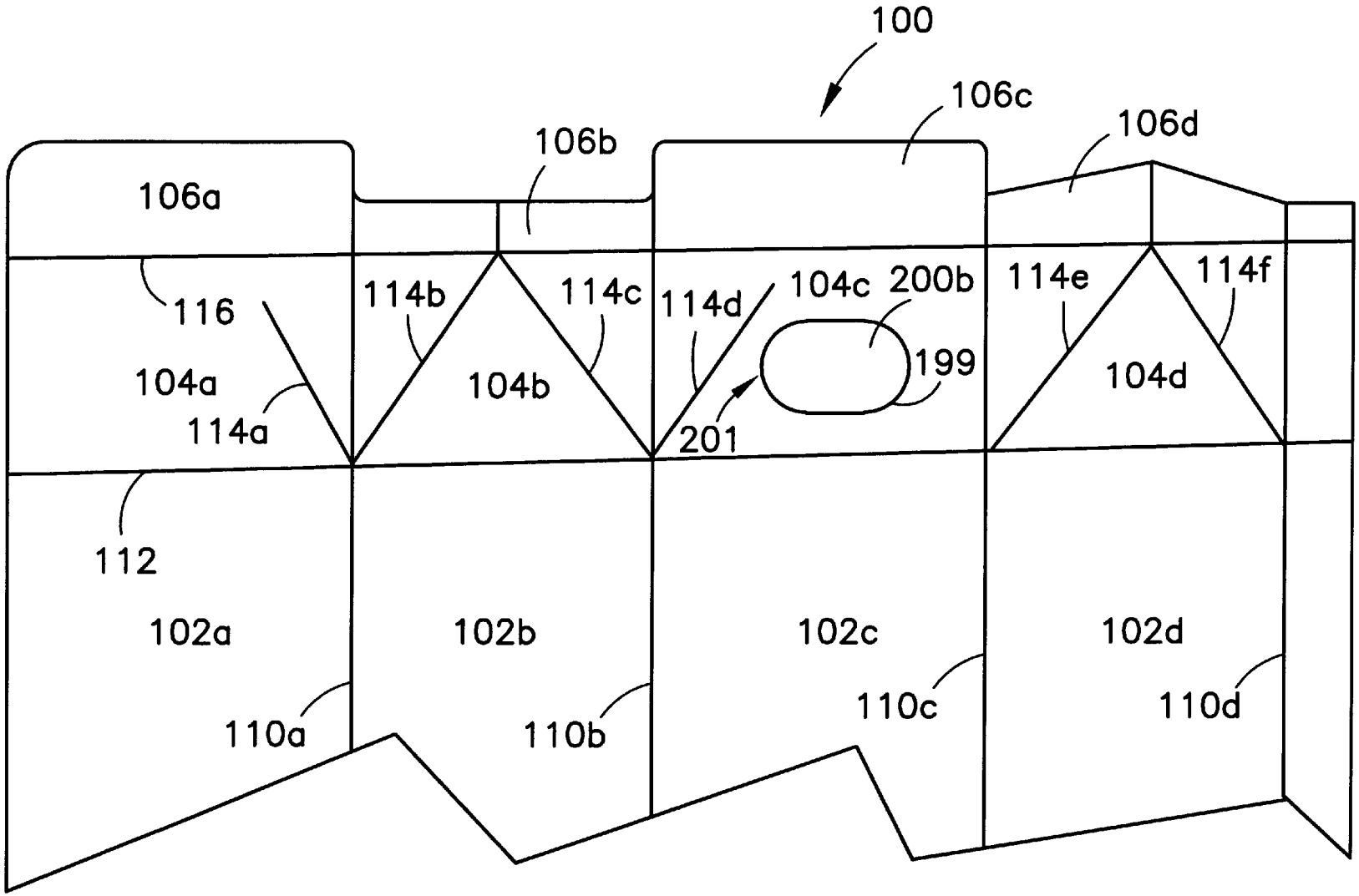
Figure 3:
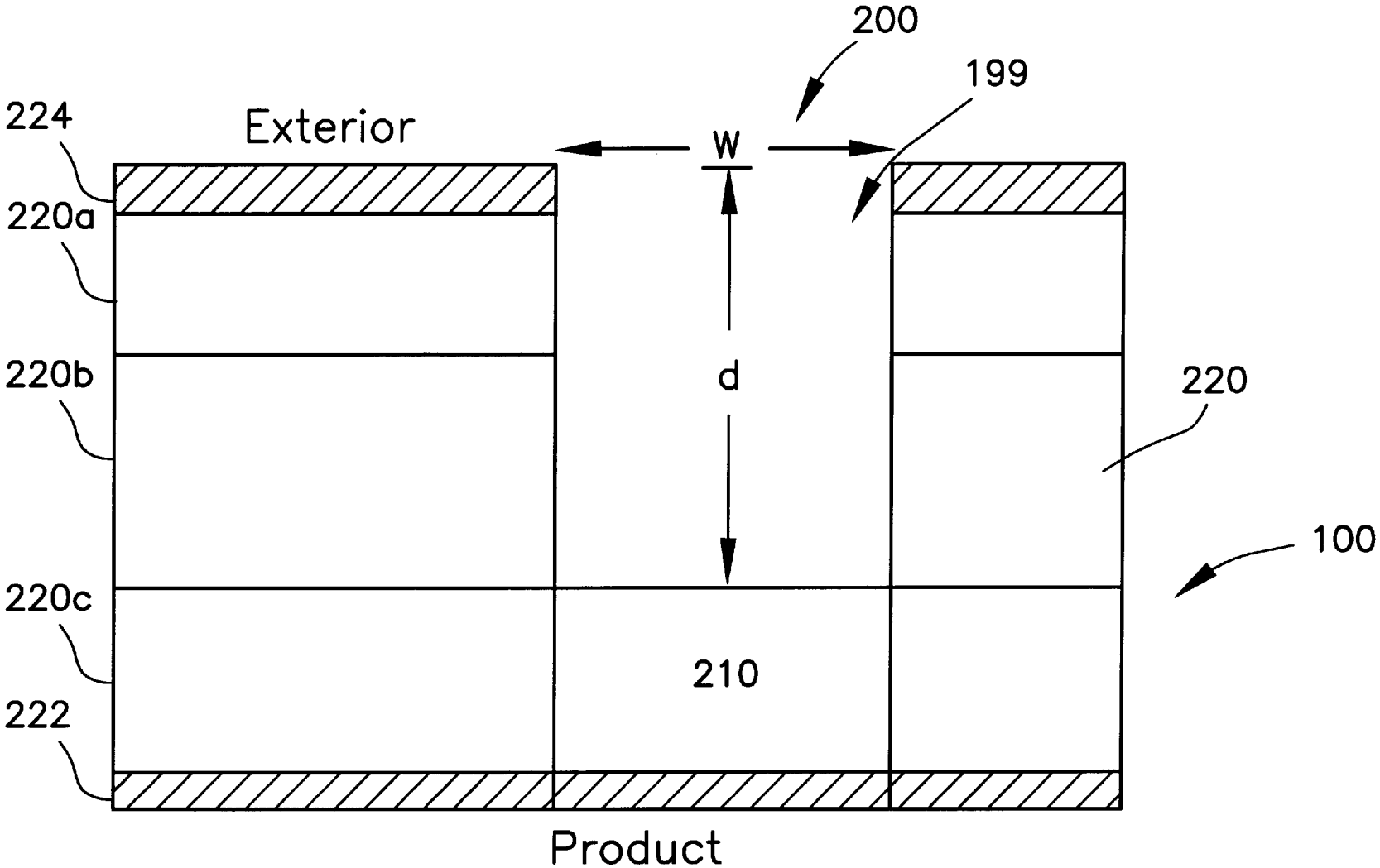

There is illustrated in FIG. 3 a cross-section view of the partial cut of either FIG. 1 or FIG.2.

Figure 3A:
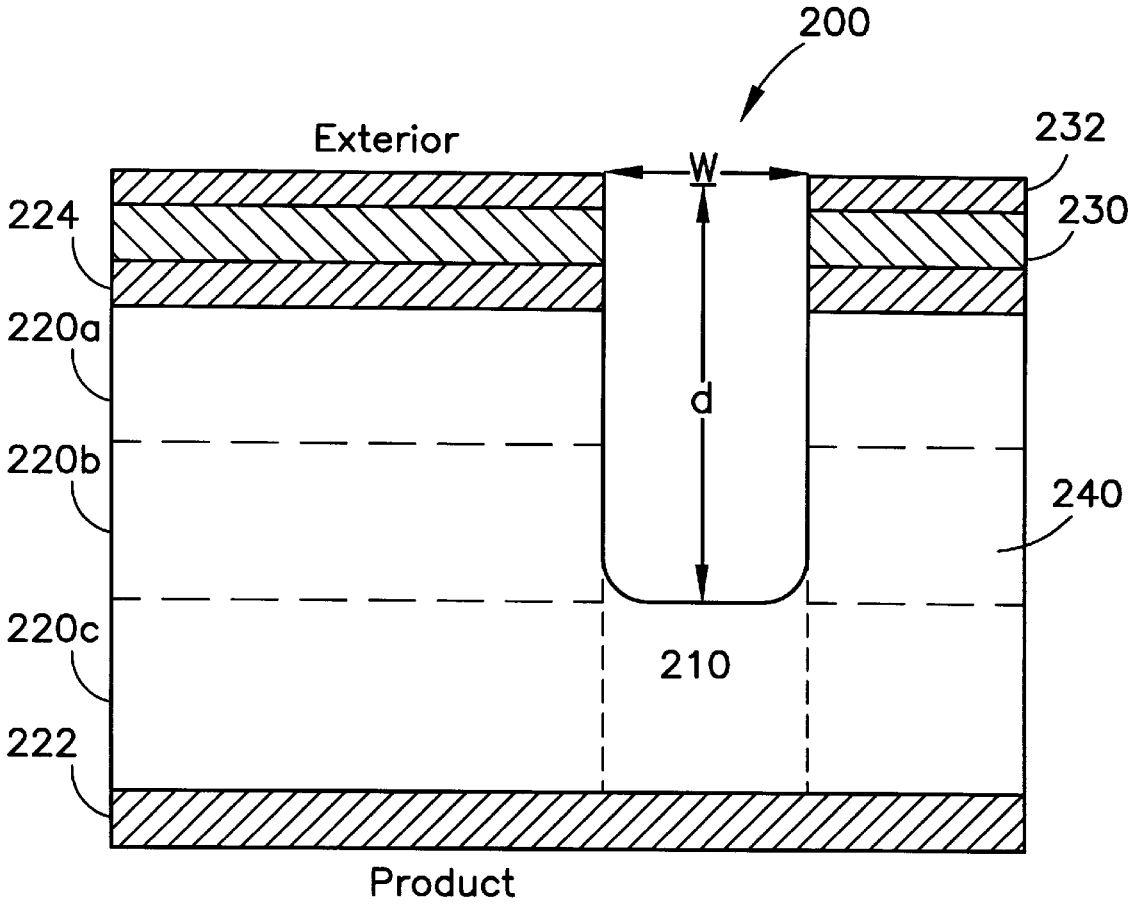

There is illustrated in FIG. 3A a cross-sectional view of the partial cut of an alternative film structure for the blanks of FIGS. 1 and 2.

Figure 4:
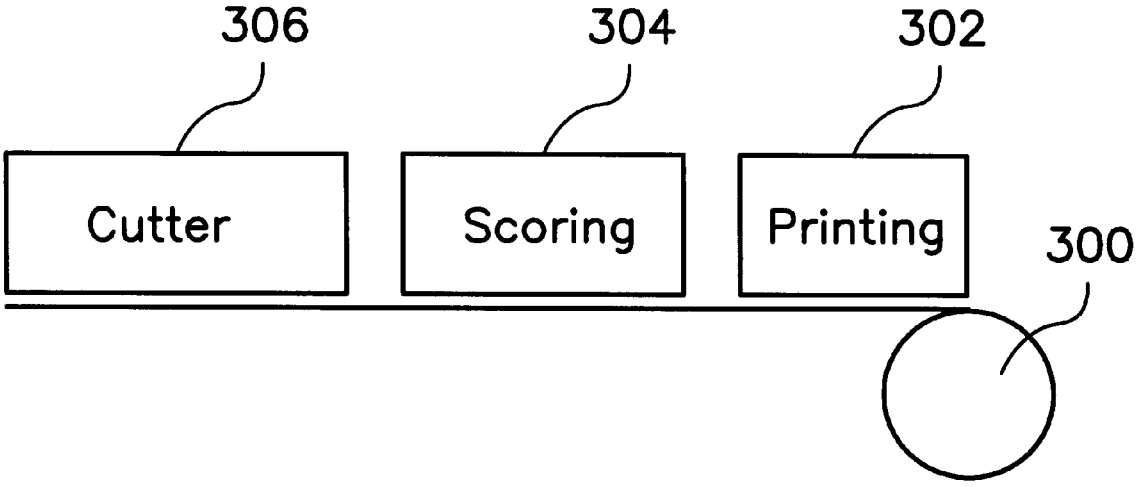

There is illustrated in FIG. 4 a schematic view of the cutting device of the present invention integrated in a converting operation for producing carton blanks.

Figure 5:
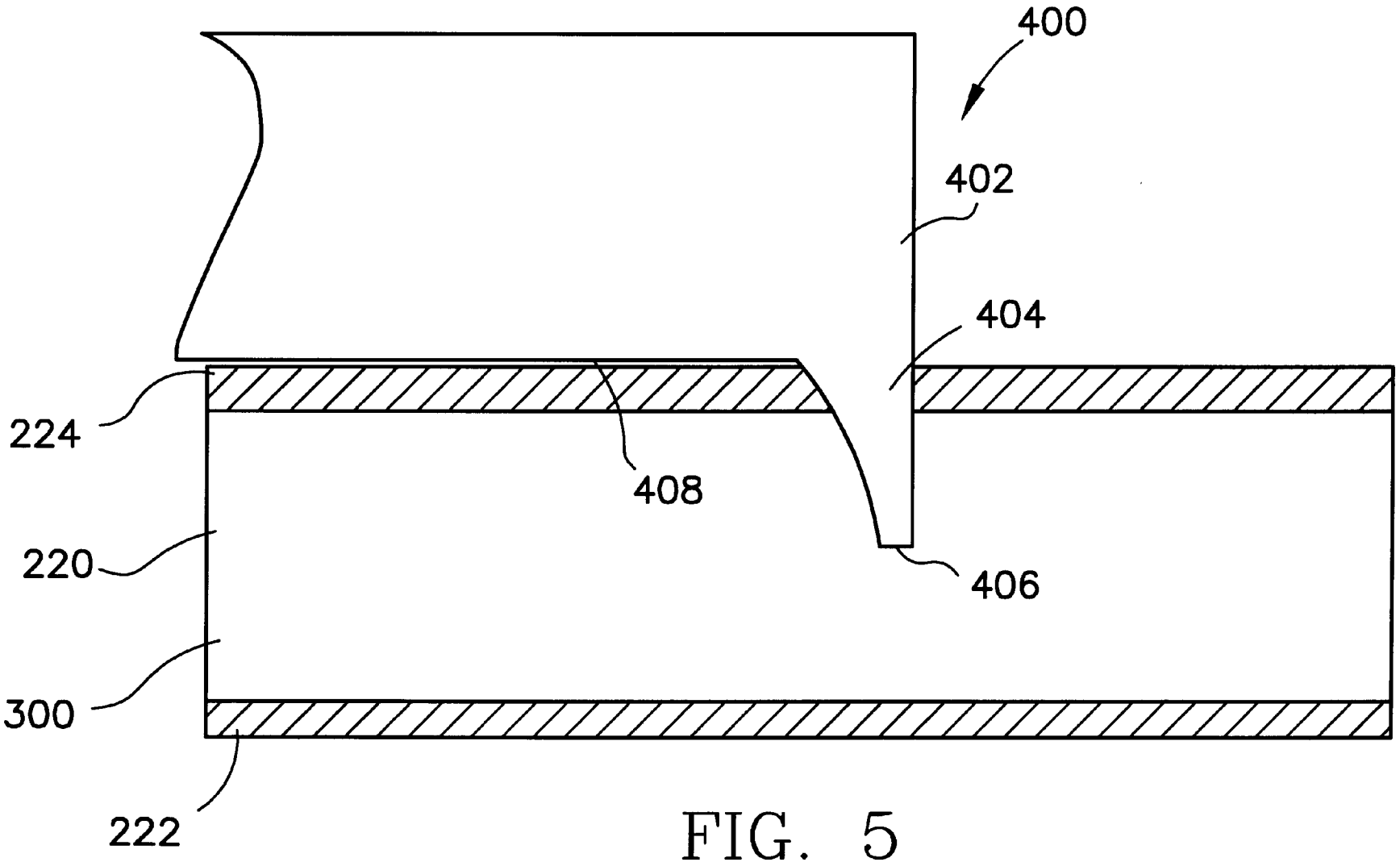

There is illustrated in FIG. 5 a cross-sectional isolated view of a cutting device of the present invention partially cutting into a packaging material.

Figure 6:
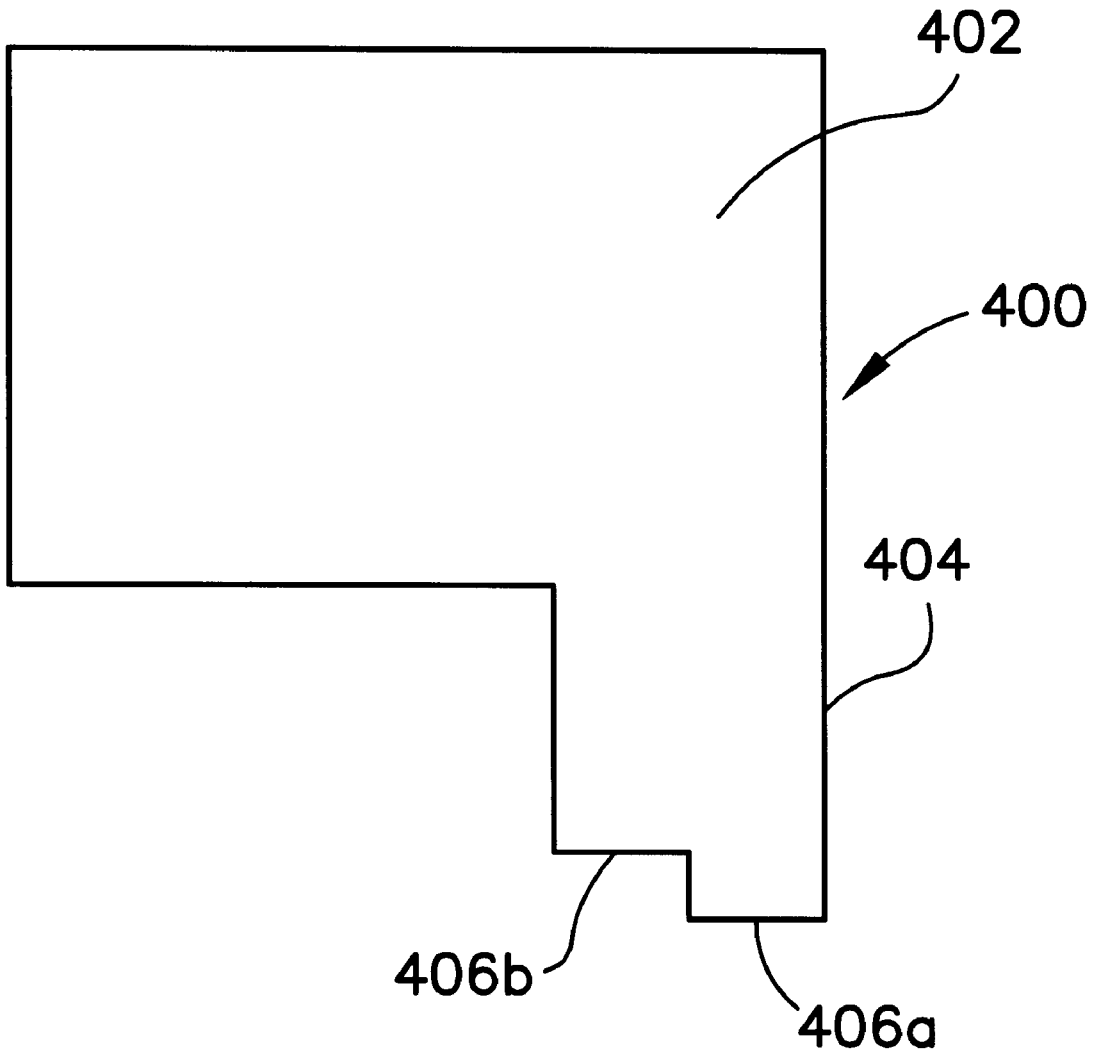

There is illustrated in FIG. 6 a cross-sectional view of an alternative cutting device of the present invention partially cutting into a packaging material.

Figure 7:
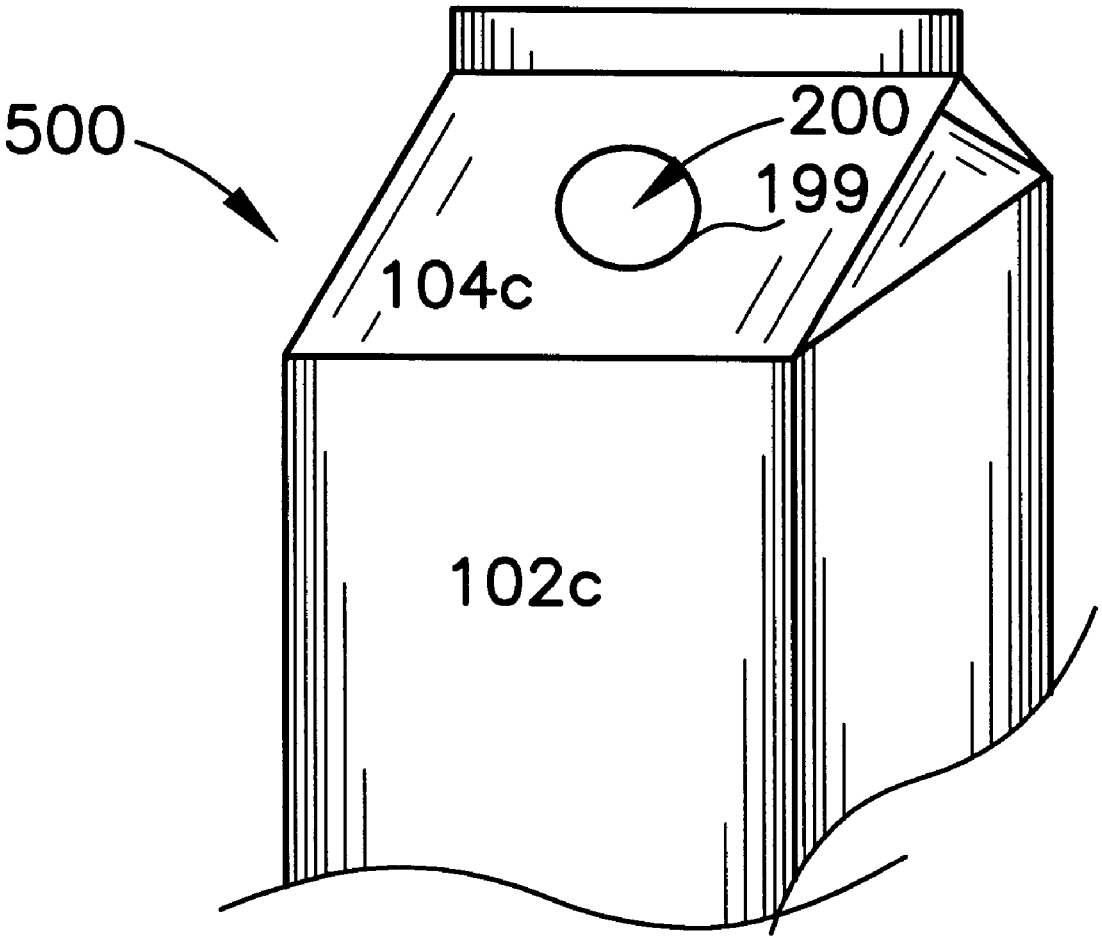

There is illustrated in FIG. 7 a top perspective view of a formed, filled and sealed carton fabricated from the blank of FIG. 1.

Figure 8:
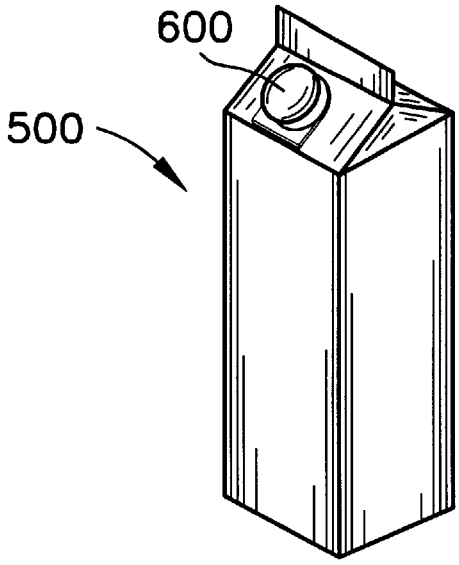

There is illustrated in FIG. 8 a top perspective view of the carton of FIG. 7 with a fitment attached thereon.

Figure 9:
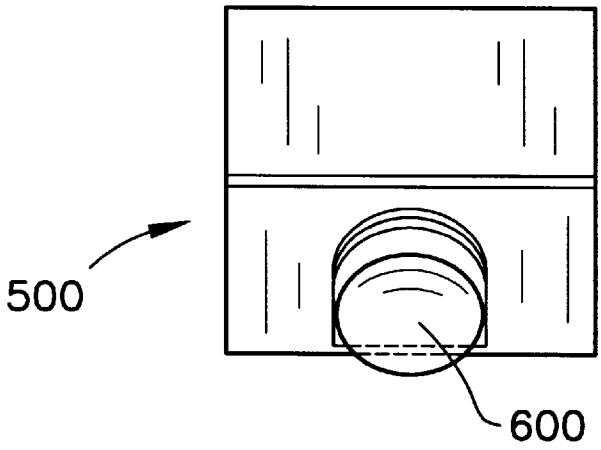

There is illustrated in FIG. 9 a top plan view of the carton of FIG. 8.

Figure 10:
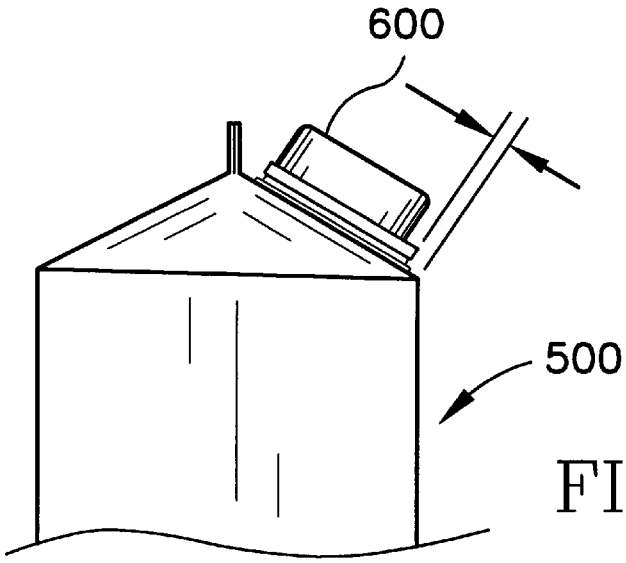

There is illustrated in FIG. 10 a side view of the carton of FIG. 8.

DETAILED DESCRIPTION OF THE INVENTION

As shown in FIGS. 1 and 2, a blank generally designated 100 includes first, second, third and fourth side panels 102*a–d*, first, second, third and fourth top panels 104*a–d*, and first, second, third and fourth top fin panels 106*a–d*. A plurality of vertical score lines 110*a–d* partition each of the side panels 102*a–d* from each other, each of the top panels 104*a–d* from each other, and each of the top fin panels 106*a–d* from each other. A horizontal score line 112 partitions each of the top panels 104*a–d* from a corresponding side panel 102*a–d*. An upper horizontal score line 116 partitions each of the top panels 104*a–d* from a corresponding top fin panel 106*a–d*. A plurality of diagonal score lines 114*a–f* creased into the top panels 104*a–d* define the folding operation of the blank 100.

One of the top panels 104*c* has a partial incision 199 thereto to define an access area 200. The access area has an uncut portion 201 which assists in retention of the access area until it is ruptured by a fitment during the initial opening of the fitment. The partial incision 199, and hence the access area 200 may have a substantially circular shape 200*a* as shown in FIG. 1, a substantially oval shape 200*b* as shown in FIG. 2, or any other shape as long as the access area 200 allows for rupturing by a fitment attached to the access area after fabrication of the blank 100 into a carton.

As shown in FIG. 3, the partial incision 199 of the access area 200 has a predetermined depth "d" into the packaging material of the blank 100. The depth d may be dependent on the particular packaging material, the requirements of the fitment, and the product contained within the finished carton. The unincised portion 210 provides the necessary protection against unwanted matter (solid, liquid or vapor) entering the carton between the sealing of the carton on a package machine and the application of a fitment to the access area by a post processing fitment applicator.

The film structure of the packaging material of the blank 100 may be a paperboard substrate 220 coated with a thermoplastic such as polyethylene on both in the interior surface 222 and the exterior surface 224 as shown in FIG. 3. Alternatively, the film structure of the packaging material of the blank 100 may have the basic structure of FIG. 3 supplemented by a barrier layer 230, usually aluminum, as shown in FIG. 3A, to provide greater barrier properties to the finished product. An additional thermoplastic layer 232 is coated on the barrier layer 230. Those skilled in the art will recognize that various film structures may be utilized without departing from the spirit and scope of the present invention.

The depth d of the partial incision 199 may correspond to the three subsections of the paperboard layer 220. The paperboard may be partitioned into an exterior subsection 220*a*, a middle subsection 220*b* and an interior subsection 220*c*. The subsections roughly correspond to the layering of the paperboard during its fabrication process. The depth d may be at the intersection of the middle subsection 220*b* and the interior subsection 220*c*. The width "w" of the partial incision 199 should be sufficient to accommodate a piercing edge of a fitment in order to rupture the unincised portion 210 of the access area 200 to access the product within a carton.

The width w and the depth d are determined by the cutting device that is utilized to create the partial incision 199 in the blank 100 during a converting process. As shown in FIG. 4, a roll of paperboard packaging material 300, coated with a thermoplastic first undergoes printing at a printing station 302 during the converting process. During the printing, a predetermined graphic image and/or wording are printed on the packaging material using various printing methods such as offset printing. Next, the packaging material 300 is scored at a scoring operation 304 to define the folding operation of each individual blank. Next, the packaging material is cut at a cutter operation 306 to cut the packaging material into individual blanks. At the cutting operation, the cutting device of the present invention partially incises the blanks to create the blank 100, with an access area 200, of the present invention.

As shown in FIG. 5, the cutting device 400 of the present invention partially incises the packaging material 300 to create the access area 200. The cutting device 400 has a body 402 with a cutting portion 404. The cutting portion 404 may have a flat edge 406. The surface 408 of the body 402 rests on the packaging material 300 as the cutting portion cuts into the packaging material 300 at a depth d to provide the partial incision 199. The cutting device 400 will have a sharp edge at the top of the cutting portion 404. The cutting portion 404 may also have varying heights. In order to achieve the oval cut of the access area 200*b* of the blank 100 of FIG. 2, the cutting portion 406 has a special radius with different flat angle edges 406*a–b* to achieve the special cut as shown in FIG. 6. The radius of the incision of the cutting portion 404 will correspond to a shaft, not shown, that is connected to the cutting device 400.

As shown in FIG. 7, a carton 500 fabricated from a blank 100, has the access area 200 on the top panel 104*c* of the gable top carton 500. The carton may be fabricated on a linear form, fill and seal packaging machine such as a TETRA REX packaging machine available from Tetra Pak. The formed, filled and sealed carton 500 of FIG. 7, is then transported to a post processing fitment applicator, such as disclosed in co-pending U.S. Patent Application 09/238,803 (Corporate Docket Number TRX-0613), entitled Post Processing Fitment Applicator, filed on Jan, 28, 1999, and which relevant parts are hereby incorporated by reference.

As shown in FIGS. 8–10, a fitment 600 is placed over the access area 200 of the carton 500 to produce a carton fabricated from a blank with a partial incision 199, with a post processing applied fitment 600 to access the product in the carton 500.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A method for converting a web of packaging material into a plurality of blanks for gable top cartons, each of the blanks having a partial incision thereto to define an access area, the method comprising:

moving a web of packaging material through a printer;

moving the web through a scoring machine to define a plurality of blanks;

moving the web to a cutter;

incising a partial incision by a cutting device to each of the plurality of blanks on the web, the partial incision defining an access area of each of the blanks; and cutting the web into individual blanks.

2. The method according to claim 1 further comprising scoring the web of packaging material at the scoring machine.

3. The method according to claim 1 wherein the incision is substantially oval in shape.

4. The method according to claim 1 wherein the incision is substantially circular in shape.

5. The method according to claim 1 wherein the depth of the partial incision is half the thickness of the packaging material.

6. The method according to claim 1 wherein the packaging material is composed of a paperboard substrate coated on an interior surface and an exterior surface with a thermoplastic, and the partial incision has a depth between the interior surface and the exterior surface.

7. The method according to claim 1 wherein the cutting device comprises a body and a cutting portion, the cutting portion having a flat angled edge.

* * * * *